United States Patent [19]

Ilnyckyj

[11] 4,058,371

[45] Nov. 15, 1977

[54] POLYMER COMBINATIONS USEFUL IN DISTILLATE HYDROCARBON OILS TO IMPROVE COLD FLOW PROPERTIES

[75] Inventor: Stephan Ilnyckyj, Maplewood, N.J.

[73] Assignee: Exxon Research & Engineering Co., Linden, N.J.

[21] Appl. No.: 689,740

[22] Filed: May 25, 1976

[51] Int. Cl.[2] ..... C10L 1/18

[52] U.S. Cl. ..... 44/62; 44/70

[58] Field of Search ..... 44/62, 70

[56] References Cited

U.S. PATENT DOCUMENTS

| | | | |
|---|---|---|---|
| 3,126,364 | 3/1964 | Ilnyckyj | 44/62 |
| 3,329,658 | 7/1967 | Fields | 44/62 |
| 3,536,461 | 10/1970 | Mueller et al. | 44/62 |
| 3,574,575 | 4/1971 | Gee et al. | 44/62 |
| 3,812,034 | 5/1974 | Gaydasch | 44/62 |

*Primary Examiner*—Daniel E. Wyman
*Assistant Examiner*—Mrs. Y. Harris-Smith
*Attorney, Agent, or Firm*—Roland A. Dexter; Frank T. Johmann

[57] ABSTRACT

Oil-soluble aliphatic copolymer having the property of a nucleator for wax crystallization e.g., ethylenevinyl acetate copolymers having a number average molecular weight within the range of 500–50,000, in combination with an oil-soluble derivative of an aromatic copolymer are useful in improving the cold flow properties of distillate hydrocarbon oils.

6 Claims, No Drawings

POLYMER COMBINATIONS USEFUL IN DISTILLATE HYDROCARBON OILS TO IMPROVE COLD FLOW PROPERTIES

BACKGROUND OF THE INVENTION

1. Field of the Invention

The invention relates to an additive combination of an oil-soluble aliphatic copolymer having the property of a nucleator for wax crystallization e.g., ethylenevinyl acetate copolymer, with an oil-soluble derivative of an aromatic copolymer. This combination is particularly useful in distillate fuel oil having a final boiling point above about 370° C., for the prevention of oil gelation and/or particularly controlling the size of wax crystals that form at low temperatures.

2. Description of the Prior Art

Various polymers, useful as middle distillate pour point depressants, prepared from ethylene have been described in the patent literature. These pour depressants include copolymers of ethylene and vinyl esters of lower fatty acids such as vinyl acetate (U.S. Pat. No. 3,048,479); copolymers of ethylene and alkyl acrylates (Canadian Patent 676,875); terpolymers of ethylene with vinyl esters and alkyl fumarates (U.S. Pat. Nos. 3,304,261 and 3,341,309); polymers of ethylene (British Pat. Nos. 848,777 and 993,744); chlorinated polyethylene (Belgian Pat. No. 707,371 and U.S. Pat. No. 3,337,313), etc.

Polymers having alkyl groups in the range of $C_6$ to $C_{18}$, such as homopolymers and copolymers of olefins, alkyl esters of unsaturated dicarboxylic acids (e.g., copolymers of dialkyl fumarate with vinyl acetate) and copolymers of olefins and said esters, are known in the art principally as lube oil pour depressants and/or V.I. improvers. For example, U.S. Pat. No. 2,379,728 teaches olefin polymers as lube pour depressants; U.S. Pat. No. 2,460,035 shows polyfumarates; U.S. Pat. No. 2,936,300 shows a copolymer of dialkyl fumarate and vinyl acetate; while U.S. Pat. No. 2,542,542 teaches copolymers of olefins, such as octadecene, with maleic anhydride esterified with alcohol, e.g., lauryl alcohol, in lubes and heating oils.

Synergistic pour point depressing combinations of various members of the above-noted two types of polymers in heavy fuels, e.g., residua and flash distillate fuels, which fuels contain relatively large amounts of waxes having on average 20 or more carbon atoms in the molecules, are taught in U.S. Pat. No. 3,726,653. The cold flow of middle distillate fuels is improved by the additive combination of 1000 to 3000 molecular weight ($\overline{M}n$) ethylene copolymer, such as ethylenevinyl acetate, and the polymer of a lauryl acrylic acid ester according to U.S. Pat. No. 3,275,427.

United Kingdom Specification No. 1,374,051 corresponding to U.S. Pat. No. 3,961,916 teaches that the low temperature flow characteristics of hydrocarbon middle distillates can be very satisfactorily controlled by the proper choice of a combination of a nucleating agent or wax growth stimulator and a wax crystal growth arrester.

U.S. Pat. No. 3,449,250 teaches that certain physical as well as some chemical properties of the heavier than gasoline liquid hydrocarbons such as fuel oils and lubricating oils, preferably those that have an initial boiling point of around 260° C., are markedly improved by the addition of a minor amount of a copolymer which imparts stability and detergency to said liquid hydrocarbons. The copolymer has a molecular weight in the range of about 500 to 150,000 and is formed of substantially equimolar portions of maleic anhydride and alpha-olefins such as ethylene, propylene, isobutylene, or styrene. The carboxyl groups of the copolymers are esterified with an aliphatic alcohol to make the copolymer oil soluble and substantially all of the remainder of the carboxyl groups are imidized.

SUMMARY OF THE INVENTION

In accordance with the present invention, a fuel composition is provided which comprises a major proportion, i.e., more than 50% by weight, of a distillate petroleum fraction and from about 0.001 to 0.5 wt. % of a flow and filterability improving composition comprising:

a. 1-20 parts by weight of an aliphatic copolymer functioning as a nucleator for wax crystallization in said distillate, and b. 1-100 parts by weight of an aromatic copolymer comprising an oil-soluble derivative of a copolymer of a vinyl aromatic monomer and an ethylenically unsaturated polar monomer, said aromatic copolymer having a number average molecular weight ($\overline{M}n$) of from about 500 to about 50,000, preferably from about 500 to about 15,000. It is preferred also that the weight ratio of a/b is in the range of 1/20 to 5/1. For purposes of this disclosure the $\overline{M}n$ is measured by Vapor Phase Osmometry (VPO) from 500 to about 15,000 and by Membrane Osmometry above 15,000.

More specifically, the aromatic copolymer can be characterized as essentially alternating copolymers of styrene and either acrylic acid esters or methacrylic acid esters or maleic anhydride. In the latter case, the anhydride groups originating from maleic anhydride are derivatized with either aliphatic alcohols and/or amines which will be later described in more detail.

It has been found that said composition prevents oil gelation and effectively controls wax crystal size in distillate hydrocarbon oils having a final boiling point in excess of 370° C.

Concentrates of 1 to 60 wt.% of said additive combination in 40 to 99 wt. % of mineral oil, e.g, kerosene, can be prepared for ease of handling.

NUCLEATOR FOR WAX CRYSTALLIZATION

The nucleator for wax crystallization is an aliphatic copolymer material which is soluble in the distillate at temperatures above the saturation temperature of the "waxy" components of said distillate but on cooling of the distillate progressively separates out as the temperature of the distillate approaches the saturation point of said "waxy" components, i.e., the distillate is cooled from a point slightly above (e.g., 10° F. above; preferably about 5° F. above) to the temperature below said saturation temperature. The term "saturation temperature" is defined at the lowest temperature at which the crystallization of the solute, i.e. petroleum waxes, cannot be initiated even if crystallization inducement methods are used.

Thus a wax nucleator raises the temperature at which the onset of wax crystallization from said distillate oil (e.g. fuel oil) occurs during cooling and is soluble in said oil at temperatures above the saturation temperature of said wax in said oil, but begins to separate out from said oil as the oil temperature approaches that of said saturation temperature.

Preferred among the polymeric wax nucleators are copolymers with a polymethylene backbone which is divided into segments by hydrocarbon, halogen, or oxy-hydrocarbon side chains, (usually prepared by free radical polymerization which might result in some branching) and comprises about 3 to 40, preferably 4 to 20, molar proportions of ethylene per molar proportion of an ethylenically unsaturated ester monomer (or mixture of unsaturated esters). An optimal polymer is a copolymer of ethylene with 0.3 to 12 mole % of vinyl acetate. These copolymers will generally have a molecular weight ($\overline{Mn}$) in the range of from about 500 to 50,000, preferably about 1500 to about 30,000.

The unsaturated ester monomers, copolymerizable with ethylene, are the vinyl esters of $C_1$ to $C_{18}$ monocarboxylic acids, preferably $C_2$ to $C_5$ monocarboxylic acids, of the general formula:

$$R_1COO\overset{H}{C}{=}CH_2$$

wherein: $R_1$ is hydrogen or a $C_1$ to $C_{17}$, preferably a $C_1$ to $C_8$, e.g. $C_1$ to $C_4$ straight or branched chain alkyl group. Examples of such esters include vinyl acetate, vinyl isobutyrate, vinyl laurate, vinyl myristate, vinyl palmitate, etc.

These preferred copolymers are readily produced by conventional polymerization methods using a free radical initiator as in U.S. Pat. No. 3,048,479.

Other monomers that can be copolymerized with ethylene include $C_3$ to $C_{16}$ alpha monoolefins, which can be either branched or straight chain, such as propylene, isobutene, n-octene-1, isooctene-1, n-decene-1, dodecene-1, etc. Still other monomers include vinyl chloride (although essentially the same result can be obtained by chlorinating polyethylene, e.g., to a chlorine content of about 10 to 35 wt. %), acrylonitrile, acrylamide, etc. The copolymerization is conventionally obtained using free radical initiators, Ziegler-Natta catalysts, etc.

The preferred copolymers can be formed as follows: solvent, and 5–50 wt. % of the total amount of monomer charge other than ethylene are charged to a stainless steel pressure vessel which is equipped with a stirrer. The temperature of the pressure vessel is then brought to the desired reaction temperature, e.g., 70° to 250° C., and pressured to the desired pressure with ethylene, e.g., 700 to 25,000 psig, usually 900 to 7,000 psig. The initiator, usually dissolved in solvent so that it can be pumped, and additional amounts of the monomer charge other than ethylene, e.g. the vinyl ester, can be added to the vessel continuously, or at least periodically, during the reaction time. Also during this reaction time, as ethylene is consumed in the polymerization reaction, additional ethylene is supplied through a pressure controlling regulator so as to maintain the desired reaction pressure fairly constant at all times. Following the completion of the reaction, usually a total reaction time of ¼ to 10 hours will suffice, the liquid phase is discharged from the reactor and solvent and other volatile constituents of the reaction mixture are stripped off leaving the copolymer as residue. To facilitate handling and later oil blending, the polymer is dissolved in a light mineral oil to form a concentrate usually containing 10 to 60 wt. % of copolymer.

Usually, based upon 100 parts by weight of copolymer to be produced, about 50 to 1200, preferably 100 to 600 parts by weight of solvent, usually a hydrocarbon solvent such as benzene, hexane, cyclohexane, t-butyl alcohol, etc., and about 1 to 20 parts by weight of initiator will be used.

The initiator is chosen from a class of compounds which at elevated temperatures undergo a breakdown yielding radicals, such as peroxide or azo-type initiators, including the acyl peroxides of $C_2$ to $C_{18}$ branched or unbranched carboxylic acids, as well as other common initiators. Specific examples of such initiators include dibenzoyl peroxide, di-tertiary butyl peroxide, t-butyl perbenzoate, t-butyl peroctoate, t-butyl hydroperoxide, alpha, alpha', azodiisobutyronitrile, dilauroyl peroxide, etc. Dilauroyl peroxide is preferred when the polymer is made at a low temperature, e.g., 70° to 135° C., while di-tert. butyl peroxide is preferred at higher polymerization temperatures.

OIL-SOLUBLE DERIVATIVES OF AN AROMATIC COPOLYMER

The second component of these flow improvers for distillate oils are oil-soluble derivatives of copolymers of a monovinyl aromatic monomer, e.g. styrene, and at least one ethylenically unsaturated polar monomer usually containing from 8 to 52 carbons, preferably 10 to 32 carbons and generally consisting of carbon, hydrogen and one or more elements selected from the group consisting of oxygen, nitrogen, halogen and sulfur.

The monovinyl aromatic monomer useful herein is preferably a $C_8$ to $C_{20}$ monovinyl aromatic compound including alpha-methylstyrene and the preferred species styrene.

In a preferred sense, these polar monomers may be represented by the general formula:

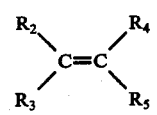

wherein $R_2$ and $R_4$ are independently selected from the group consisting of hydrogen, halogen and a $C_1$ to $C_{12}$ alkyl radical such as methyl; $R_3$ is selected from the group consisting of carboxy (—COOH), cyano (—CN), hydroxymethyl (—$CH_2$—OH), carboalkoxy (—COOR), alkoxy methyl (—$CH_2$—O—$R_6$), methyl hydrocarbyl ketone (—$CH_2$—CO—$R_6$) and one-half of cyclic dicarboxylic acid anhydride (as in maleic anhydride); $R_5$ is selected from the group consisting of hydrogen, carboxy (—COOH), cyano (—CN) and carboalkoxy (—$COOR_6$); and $R_6$ is selected from the group consisting of $C_1$ to $C_{24}$ straight and branched-chain alkyl, arylalkyl and cycloalkyl radicals.

The oil-soluble derivatives of said copolymers of a monovinyl aromatic monomer and a polar monomer can be obtained either by derivatizing said polar monomer and thereafter copolymerizing or by derivatizing said copolymers. In the case of acidic polar monomers such as acrylic or methacrylic acids it is customary to first derivatize them, e.g. to esters, amides or ester-amides, and then copolymerize with a vinyl aromatic monomer. On the other hand, when maleic anhydride is used as a comonomer it is preferred to copolymerize it with the monovinyl aromatic monomer and then to derivatize the already so formed copolymer on its anhydride sites. The derivatization can be accomplished using alcohols containing from 1 to 60 carbons thus forming esters, amines containing from 1 to 60 carbon atoms and 1 to 12 nitrogen atoms thus forming amides or any ratio of said alcohols and said amines thus forming ester-amide derivatives.

A particularly useful class are oil-soluble derivatives of copolymers of a monovinyl aromatic monomer having between about 8 and 20 carbons in the molecule, e.g. styrene and a dicarboxylic acid material (either as an anhydride such as maleic anhydride or a dicarboxylic acid such as fumaric acid or maleic acid). More usually the styrene-maleic anhydride copolymers are formed by copolymerization of substantially equimolar amounts of the monomers. The resulting copolymers should have a $\overline{Mn}$ in the range of about 500 to about 150,000 as should the acrylate copolymers.

Another particularly useful class of the oil-soluble derivatives are the acrylate copolymers of a $C_8$ to $C_{20}$ monovinyl aromatic monomer, e.g. styrene and acrylic or methacrylic derivatives represented by the formulae:

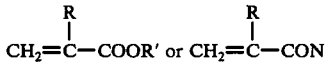

wherein R represents hydrogen or methyl, R′ represents alkyl group of 8 to 24 carbon atoms and N represents an amine containing 1 to 60 carbon atoms and 1 to 12 nitrogen atoms. The alkyl group of R′ is preferably essentially straight chain and contains 12 to 18 carbon atoms although methyl and ethyl branching can be tolerated. The acrylic or methacrylic monomers from which the copolymer is derived includes alkyl acrylate, alkyl methacrylate, alkyl aminoacrylates and alkyl aminomethacrylates such as lauryl acrylate, lauryl methacrylate, N,N-dimethylaminoethyl methacrylate, etc.

The alcohols suitable for use in producing the esters of the copolymer of a monovinyl aromatic monomer, e.g., styrene and a dicarboxylic acid material, e.g. maleic anhydride are generally aliphatic alcohols having from about 1 to 60 carbons per molecule. Saturated aliphatic alcohols containing 6 to 22 carbon atoms per molecule are preferred. Examples of alcohols suitable for use in producing the esters include straight chain normal primary alcohols such as ethyl, propyl, butyl, hexyl, octyl, lauryl, octadecyl, eicosyl, docosyl, tricosyl, tetracosyl, pentacosyl, hexacosyl, etc. Polyols containing from about 2 to about 10 hydroxy groups can be utilized as well, e.g. glycerol, alkylene glycols such as dipropylene glycol, trimethylol methane, pentaerythritol, etc.

Commercially available mixtures of alcohols consisting essentially of saturated alcohols of the requisite chain length may be employed in preparing the long chain esters. One such mixture is marketed under the trade name Behenyl alcohol and is a mixture of $C_{16}$–$C_{24}$ alcohols derived from natural sources.

Useful amine compounds for amination/imidation of the copolymers according to this invention include mono- and polyamines of about 1 to 60, e.g., 3 to 20, total carbon atoms and about 1 to 12, e.g. 2 to 6 nitrogen atoms in the molecule, which amines may be hydrocarbyl amines or may be hydrocarbyl amines including other groups, e.g., hydroxy groups, alkoxy groups, amide groups, imidazoline groups, and the like. Preferred amines are aliphatic, primary and secondary amines including polyamines. It is possible to substitute up to 25 mole percent of said amines with primary or secondary aromatic amines. The preferred amines include those of the general formulae:

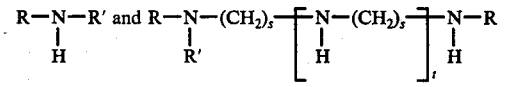

wherein R and R′ are independently selected from the group consisting of $C_1$ to $C_{25}$ straight or branched chain alkyl radicals, $C_1$ to $C_{12}$ alkoxy $C_2$ to $C_6$ alkylene radicals, $C_2$ to $C_{12}$ hydroxy or amino alkylene radicals, and $C_1$ to $C_{12}$ alkylamino $C_2$ to $C_6$ alkylene radicals, and R′ can also be hydrogen, *s* is a number of from 2 to 6, preferably 2 to 4; and *t* is a number of from 0 to 10, preferably 2 to 6.

Non-limiting examples of suitable amine compounds include: mono- and di-tallow amines; 1,2-diaminoethane; 1,3-diaminopropane; 1,4-diaminobutane; 1,6-diaminohexane; diethylene triamine; triethylene tetraamine; tetraethylene pentamine; 1,2-propylene diamine; di-(1,2-propylene) triamine; di-(1,3-propylene) triamine; N,N-dimethyl-1,3-diaminopropane; N,N-di-(2-aminoethyl) ethylene diamine; N,N-di-(2-hydroxyethyl)-1,3-propylene diamine; 3-dodecyloxypropylamine; N-dodecyl-1,3-propane diamine, tris-hydroxymethyl methylamine, diisopropanol amine, and diethanol amine.

Other useful amine compounds include: alicyclic diamines such as 1,4-di-(aminomethyl) cyclohexane, and heterocyclic nitrogen compounds such as imidazolines and N-aminoalkyl piperazines of the general formula:

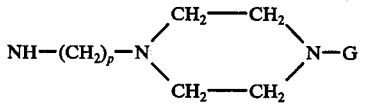

wherein G is independently selected from the group consisting of hydrogen and omega-aminoalkylene radicals of from 1 to 3 carbon atoms; and p is an integer of from 1 to 4. Non-limiting examples of such amines include 2-pentadecyl imidazoline; N-(2-aminoethyl) piperazine; N-(3-aminopropyl) piperazine; and N,N′-di-(2-aminoethyl) piperazine.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene groups, forming such compounds as diethylene triamine, triethylenetetramine, tetraethylene pentamine and isomeric piperazines. Low cost poly(ethylene amines) compounds having a composition approximately tetraethylene pentamine are available commercially under the trade name Polyamine 400 (PA-400), marketed by Jefferson Chemical Co., New York, N.Y. Similar materials may be made by the polymerization of aziridine, 2-methyl aziridine and azetidine.

Still other amines separated by hetero atom chains such as polyethers or sulfides can be used.

Also included are primary and secondary amines having 2 to 3 hydroxy groups such as tris-hydroxymethyl amino-methane, diisopropanolamine, 2-amino-2-methyl-1,3- propane diol, 2-amino-2-ethyl-1,3propane diol, etc.

The method of making monovinyl aromatic copolymers and the esterification and/or amidation and/or imidation thereof using alcohol and amines is quite adequately broadly described in the prior art in U.S. Pat. No. 2,615,854 and the teachings of this patent are incorporated herein by reference. The polymerization of the monovinyl aromatic monomer and ethylenically unsaturated esterified (including the partially esterified) monomer can be conducted by free radical initiated polymerization techniques as those earlier set forth in this specification with regard to preparation of the nucleator for wax crystallization.

The distillate hydrocarbon oils wich are treated with the additive package of this invention are wax-containing distillate petroleum oils boiling in the range of 120° to 500° C.

The invention is particularly effective for the cold flow treatment of high end point fuels whih are nonresponsive to conventional flow improvers, i.e., those fuels having a final boiling point have about 370° C. (ASTM-1160).

The combinations of the invention may be used alone or in combination with still other oil additives, e.g., corrosion inhibitors; antioxidants, sludge inhibitors, etc.

The invention will be further understood by reference to the following examples which include preferred embodiments of the invention.

EXAMPLES

The following materials were used:

Polymer 1

Polymer 1 is a copolymer of ethylene and vinyl acetate produced as outlined in U.K. Specification No. 1,374,051 and having $\overline{M}n$ of about 4100, a vinyl acetate content of 9 wt. % and a specific viscosity of 0.37. This copolymer is also described in U.S. Pat. No. 3,961,916. (corresponding to said U.K. specification) as copolymer K.

Polymer A

Polymer A was a styrene-maleic anhydride copolymer which has been esterified with aliphatic alcohols and amidized with an alkylamine dissolved in mineral oil and purchased as HiTec 672 from Monsanto Chemical Co. of St. Louis, Missouri. It is believed to be 33% by weight of said copolymer having a $\overline{M}n$ of about 14,800 and composed of 78.37 wt. % carbon, 10.93 wt. % hydrogen and 0.38 wt. % nitrogen. The linear primary alcohols of said copolymer are believed to have from 10 to 18 carbons.

Polymer B

Polymer B was a copolymer of styrene and lauryl methacrylate dissolved in mineral oil and purchased as Santopour C from Monsanto Chemical Co. of St. Louis, Missouri.

The Fuel

The properties of the distillate fuel oils tested are summarized in Table I which follows:

| | Distillate Fuels | |
|---|---|---|
| | A | B |
| Cloud Point, ° C. | −2 | +5 |
| n-Paraffin Range, C# | 18–34 | 16–38 |
| Distillation, ° C. (per ASTM-D-1160) | | |
| IBP | 161.1 | 178.9 |
| FBP | 416 | 453 |

Various blends of Polymer 1 with Polymers A and B in the fuel were made by simply dissolving polymer in the fuel oil. This was done while warming, e.g., heating the oil and polymer to about 90° C. if the polymer per se was added, and stirring. In other cases, the polymer was simply added with stirring to the fuel in the form of an oil concentrate which was usually about 50 wt. % polymer dissolved in a light mineral oil.

The blends were then tested for their cold flow properties in the tests described below.

The Cold Filter Plugging Point Test (CFPPT)

The cold flow properties of the blend were determined by the Cold Filter Plugging Point Test (CFPPT). This test is carried out by the procedure described in detail in "Journal of the Institute of Petroleum," Volume 52, Number 510, June 1966 pp. 173–185. In brief, a 40 ml. sample of the oil to be tested is cooled by a bath maintained at about −34° C. Periodically (at each one degree Centigrade drop in temperature starting from 2° C. above the cloud point) the cooled oil is tested for its ability to flow through a fine screen in a time period. This cold property is tested with a device consisting of a pipette to whose lower end is attached an inverted funnel positioned below the surface of the oil to be tested. Stretched across the moutn of the funnel is a 350 mesh screen having an area of about 0.45 square inch. The periodic tests are each initiated by applying a vacuum to the upper end of the pipette whereby oil is drawn through the screen up into the pipette to a mark indicating 20 ml. of oil. The test is repeated with each one degree drop in temperature until the oil fails to fill the pipette within 60 seconds. The results of the test are reported as the temperature in ° C. at which the oils fail to fill the pipette in the prescribed time.

Imperial Filterability Test (IFT)

In this test a 200 ml sample of oil is cooled at a rate of 1° F./hr. from 5.6° C. above to 2.8° C. below its true cloud point at which temperature the oil is passed under 12 inches of water vacuum through a filter element provided with a screen. The Imperial Filterability is reported in terms of the finest screen through which at least 90% of sample will pass under a suction of 12 inches of water in time not exceeding 25 seconds. The true cloud point employed in IFT as the reference point is the temperature at which the formation of wax crystals is first observed when a sample of oil is cooled under stirring at a rate of 20° F./hr.

The blends prepared and the test results are summarized in Table II which follows:

TABLE II

EFFECTIVENESS OF POLYMERS IN THE FUEL

| | | Oil A | | Oil B | |
|---|---|---|---|---|---|
| Example | Polymer | CFPPT° C. | IFT Mesh passed | CFPPT° C. | IFT Mesh passed |
| 1 | None | 20 | 20 | 1.1 | 80 |
| 2 | 0.02% Polymer 1 | −12 | 100 | — | — |

TABLE II-continued

EFFECTIVENESS OF POLYMERS IN THE FUEL

| Example | Polymer | Oil A CFPPT° C. | Oil A IFT Mesh passed | Oil B CFPPT° C. | Oil B IFT Mesh passed |
|---|---|---|---|---|---|
| 3 | 0.02% Polymer A | 0 | 100 | — | — |
| 4 | 0.02% Polymer B | −10 | 270 | — | — |
| 5 | 0.01% Polymer 1<br>0.01% Polymer A | −13 | 270 | — | — |
| 6 | 0.01% Polymer 1<br>0.01% Polymer B | −16 | 270 | — | — |
| 7 | 0.05% Polymer 1 | — | — | −3 | 100 |
| 8 | 0.05% Polymer A | — | — | −2 | 60 |
| 9 | 0.05% Polymer B | — | — | −9 | 60 |
| 10 | 0.025% Polymer 1<br>0.025% Polymer A | — | — | −10 | 270 |
| 11 | 0.025% Polymer 1<br>0.025% Polymer B | — | — | −16 | 270 |

The synergistic results obtained by the teachings of this invention are apparent from the foregoing Table II, e.g., in Oil A the blend of Example 2 gives a CFPPT of −12° C., the blend of Example 4 gives a CFPPT of −10° C., whereas 50/50 mixtures of the blends of Examples 2 and 4 (Example 6) give a markedly lower CFPPT of −16° C. (similarly synergism is apparent in the results of Examples 2, 3 and 5 whereby the CFPPT is lowered to −13° C.); and in Oil B the blend of Example 7 gives a CFPPT of −3° C., the blend of Example 9 gives a CFPPT of −9° C., whereas 50/50 mixtures of the blends of Examples 7 and 9 give a CFPPT of −16° C.; (see Example 11).

It is to be understood that the examples presented in the foregoing specification are merely illustrative of this invention and not to be limited by any theory regarding its operability. The scope of the invention is to be determined by the appended claims.

I claim:

1. A wax-containing distillate petroleum fuel oil boiling in the range of 120° to 500° C. and having a final boiling point above about 370° C., which has been improved in its low temperature flow properties, containing in the range of about 0.001 to 0.5 wt. %, based on the weight of the total composition, of a synergistic flow improving combination of:

a. aliphatic copolymer functioning as a nucleator for wax crystallization in said distillate, wherein said nucleator is a copolymer of ethylene and a vinyl ester of a $C_1$ to $C_8$ saturated aliphatic monocarboxylic acid, said copolymer having a ($\overline{Mn}$) of from about 500 to 50,000 and in the range of 3 to 40 molar proportions of ethylene per molar proportion of said vinyl ester, and b. an aromatic oil soluble copolymer comprising principally $C_8$ and $C_{20}$ monovinyl aromatic monomer and ester of an ethylenically unsaturated acid selected from the group consisting of maleic anhydride, acrylic acid and methacrylic acid, esterified with a saturated, essentially straight chain alcohol having in the range of 6 to 22 carbon atoms, said aromatic copolymer having a number average molecular weight ($\overline{Mn}$) in the range of about 500 to about 50,000, and the weight ratio of (a) to (b) is in the range of 1/20 to 5/1.

2. A fuel oil according to claim 1, wherein said vinyl ester is vinyl acetate.

3. A fuel oil according to claim 2, wherein said aromatic monomer is styrene and said ester is maleic anhydride ester.

4. A fuel oil according to claim 2, wherein said aromatic monomer is styrene and said ester is a methacrylate.

5. A fuel oil is according to claim 4, wherein said methacrylate is lauryl methacrylate.

6. A wax-containing distillate petroleum fuel oil boiling in the range of 120° to 500° C. and having a final boiling point above about 370° C., which has been improved in its low temperature flow properties, containing in the range of about 0.001 to 0.5 wt. %, based on the weight of the total composition, of a synergistic flow improving combination of:

a. copolymer consisting essentially of ethylene with 0.3 to 12 mole percent of vinyl acetate, said copolymer having a number average molecular weight within the range of 1500–30,000, and b. oil-soluble copolymer having a number average molecular weight in the range of about 500 to 50,000 of styrene and ester of the formula:

$$CH_2{=}\overset{\overset{\displaystyle R}{|}}{C}{-}COOR'$$

wherein R represents hydrogen or methyl; and R′ represents a straight chain alkyl group of 12 to 18 carbon atoms, and wherein the weight ratio of (a) to (b) is in the range of about 1/20 to 5/1.

* * * * *